US008169146B2

(12) United States Patent
Naitoh et al.

(10) Patent No.: US 8,169,146 B2
(45) Date of Patent: May 1, 2012

(54) METAL HALIDE LAMP

(75) Inventors: Koichi Naitoh, Saitama (JP); Akiyoshi Maehara, Saitama (JP)

(73) Assignee: Iwasaki Electric Co., Ltd, Tokyo (JP)

( * ) Notice: Subject to any disclaimer, the term of this patent is extended or adjusted under 35 U.S.C. 154(b) by 414 days.

(21) Appl. No.: 12/485,974

(22) Filed: Jun. 17, 2009

(65) Prior Publication Data

US 2009/0315462 A1 Dec. 24, 2009

(30) Foreign Application Priority Data

Jun. 18, 2008 (JP) ..... 2008-158617

(51) Int. Cl.

| | |
|---|---|
| ***H01J 7/44*** | (2006.01) |
| ***H01J 13/46*** | (2006.01) |
| ***H01J 17/34*** | (2006.01) |
| ***H01J 19/78*** | (2006.01) |
| ***H01J 23/16*** | (2006.01) |
| ***H01J 29/96*** | (2006.01) |
| ***H01K 1/62*** | (2006.01) |

(52) U.S. Cl. ..... 315/53; 315/59; 315/73; 315/112; 315/117

(58) Field of Classification Search ..... None
See application file for complete search history.

(56) References Cited

U.S. PATENT DOCUMENTS 5,420,479 A * 5/1995 Iida et al. ..... 315/73
6,462,477 B1 * 10/2002 Wada et al. ..... 315/73

FOREIGN PATENT DOCUMENTS

JP 11-162413 6/1999

OTHER PUBLICATIONS

English language Abstract of JP 11-162413, Jun. 18, 1999.

* cited by examiner

*Primary Examiner* — Anh Tran
(74) *Attorney, Agent, or Firm* — Greenblum & Bernstein, P.L.C.

(57) ABSTRACT

A metal halide lamp capable of delaying the rate of deformation in an electrostrictive phenomenon caused by the discharge of a ferroelectric ceramic capacitor when dielectric breakdown is initiated between the electrodes of an arc tube thereby preventing breakage accident, wherein a starting circuit, housed in parallel connection together with an arc tube in an outer tube of a metal halide lamp has in serial connection, a ferroelectric ceramic capacitor that is charged and discharged when a voltage at a predetermined coercive voltage or higher is applied thereby outputting a starting pulse at a high voltage from a ballast, a semiconductor switch that turns to a conduction state when a voltage of a predetermined breakover voltage or higher is applied, and a time constant control resistor that delays the discharge time of electric charges discharged from the capacitor when dielectric breakdown is initiated in the arc tube.

6 Claims, 3 Drawing Sheets

METAL HALIDE LAMP

BACKGROUND OF THE INVENTION

Field of the Invention

The present invention concerns a starter built-in metal halide lamp in which an arc tube that causes discharge emission between electrodes and a starting circuit therefor are housed being connected in parallel with each other in an outer tube.

The starter built-in metal halide lamp incorporates therein a starting circuit for generating pulses and can emit light by utilizing an inexpensive mercury lamp ballast which has been popularized so far (refer, for example, to JP-A No. 11-162413).

In a basic structure of such a starter built-in metal halide lamp 31, as shown in FIG. 6, an arc tube 33 containing metal vapors sealed therein and a starting circuit 34 therefor are connected in parallel and housed in an outer tube 32.

The arc tube 33 is supplied with an AC lamp power from a AC power source 35 by way of a lamp power supply circuit 36 to emit light by electric discharge between electrodes 37A and 37B.

The starting circuit 34 is a circuit which changes a current in a ballast 38 intervened in the lamp power supply circuit 36 to output a starting pulse at a high voltage from the ballast 38 and generate discharge and dielectric breakdown between the lamp electrodes 37A and 38*b*. In the circuit, a ferrodielectric ceramic capacitor such as a non-linear ceramic capacitor (hereinafter simply referred to as "FEC") 39, a semiconductor switch 40 of a bilateral 2-terminal thyristor, and a fusing resistor 41 are connected in series.

A pyroelectric bypass resistor 42 is connected in parallel with the FEC 39 for bypassing a pyroelectric current which is generated when the temperature of the FEC 39 exceeds a curie temperature of about 90° C. to prevent deterioration of the characteristics thereof, and a pulse phase stabilizing resistor 43 is connected in parallel with the semiconductor switch 40.

According to the constitution described above, the semiconductor switch 40 turns to a conduction state at a high voltage where the voltage exceeds a positive or negative breakover voltage on every one-half cycle of an AC power source voltage and the FEC 39 which has been in a reverse saturation polarization state by a preceding AC cycle is discharged/charged into a normal saturation polarization state to complete charging.

By discharging/charging operation of the FEC 39 from the reverse polarization state to the normal saturation polarization state, a current flows to the ballast 38 and the current decreases to zero when the FEC 39 reaches the normal saturation polarization state.

That is, since the flow of the current flowing in the ballast 38 from the reverse saturation polarization state to the normal saturation polarization state stops suddenly, a starting pulse at a high voltage in accordance with the change of current with time and a reactance is applied to the electrodes 37A and 37B of the arc tube 33. As a result, when the dielectric breakdown is initiated between the electrodes 37A and 37B, lighting of the arc tube 33 is started.

In this case, since the amount of the current change increases more as the current value just before the transition of the FEC 39 to the normal saturation polarization state and the flow of the current stops, the voltage of the starting pulse outputted from the ballast 38 becomes higher and the arc tube 33 starts easily.

By the way, the pulse voltage Vp generated in the ballast (coil) is represented as:

$$Vp=-L(di/dt)$$

where

L: self inductance of ballast, dt: time, di: amount of current change.

In a case of applying an AC power source voltage to a capacitor, since the voltage value always changes, when the capacitor is discharged/charged to a level near a peak voltage, the discharge voltage of the capacitor is superimposed on the power source voltage and, accordingly, the current value also increases by so much and the amount of the current change is increased when the current is stopped.

Accordingly, it is adapted such that the FEC 39 is charged/discharged when the power source voltage is high by connecting the semiconductor switch 40 in series with the FEC 39 and setting the breakover voltage to a predetermined value near the peak voltage.

This provides a merit that when a starting pulse at a high voltage (about 1.6 to 2.2 kV) is outputted from the ballast 38, a starting pulse at a high voltage is applied also to the FEC 39 to additionally accumulate electric charges therein so long as this occurs before initiation of dielectric breakdown of the arc tube 33 and the current can be kept higher when it flows to the ballast in the next discharge/charge.

On the other hand, the amount of the current change di depends on the static capacitance C of the capacitor and the static capacitance C is represented as:

$$C=\in_0\in_s(S/D)$$

where

C: static capacitance

S: electrode area,

D: inter-electrode distance $\in_s$: dielectric constant of an insulator $\in_0$: dielectric constant of vacuum ($8.854\times10^{-12}$)

Then, in the FEC 39, the static capacitance increases more as the thickness of a ceramic substrate, that is, the ferroelectric body is decreased (decrease of the distance D) and the static capacitance increases more as the electrode area S opposing thereto is larger. However, when the FEC 39 is made thinner and wider, this results in a problem of lowering the mechanical strength and it has been found a case in which the FEC 39 suffers from cracking before breakage of the arc tube 33 during long time use thereby making the start-up of the lamp impossible.

Then, when the present inventors, et al have made studies for analyzing the cause thereof, it has been found a phenomenon that when the starting pulse is outputted from the ballast 38 and the dielectric breakdown is initiated between the electrodes 37A and 37B, a closed circuit is established by the starting circuit 34 and the arc tube 33 connected in parallel therewith and when electric charges charged so far in the FEC 39 are discharged abruptly from one electrode to the other electrode of the FEC 39 passing through the arc tube 33.

Since the starting pulse voltage is applied to the FEC 39 and electric charges are accumulated therein till the generation of the dielectric breakdown, amount of the electric charges discharged along with the dielectric breakdown differs greatly depending on the timing of the dielectric breakdown, and the maximum voltage value of the starting pulse (for example, 2.0 kV) is applied depending on the timing to cause discharge at a discharge voltage comparable with the voltage value at the same time with the dielectric breakdown.

Upon measurement of the discharge time, it has been found that the discharge time in which the potential lowers from 2.0 kV to 0 is 0.1 to 0.5 μsec (which is less than 1 μsec) and (the capacitor) is discharged within a time as short as about 1/100 to 1/1000 compared with the half-width of the starting pulse outputted from the ballast 38 (several tens to one hundred and several tens μsec).

Since the ferroelectric material used for the FEC 39 is also a piezoelectric material, when electric charges are accumulated, the material exhibits an electrostrictive phenomenon of generating strains in accordance with the electric field thereof and the amount of the strains also changes when the electric field is changed by discharge.

Further, the ferroelectric material has a polycrystal structure and, when individual crystals are deformed by the voltage change, positional relation between adjacent crystals to each other is displaced thereby result in a frictional force or stress.

Accordingly, it has been found that since the electric field changes more rapidly as the discharge time is shorter, the amount of deformation of the FEC 39 per unit time is larger, and this results in an impact shock to peel crystals from each other and generate cracking or breakage and, even though they are not broken, current flows to the cracking to bring about short-circuit, etc. and damage the FEC 39.

In addition, the lamp does not instantly reach stable lighting after the generation of the dielectric breakdown between the electrodes 37A and 37B, but the lamp usually repeats a phenomenon of dielectric breakdown by the starting pulse and succeeding lighting failure during a period from several deciseconds to ten and several seconds where the lamp transits from the start-up state to stable lighting in which starting pulses are outputted by the number of several to several hundreds times. Accordingly, the FEC 39 inevitably repeats deformation and vibrates for several deciseconds to ten and several seconds by the electrostrictive phenomenon on every output of the starting pulses and it is assumed that this results in cracking in the FEC 39.

As a countermeasure, while the mechanical strength is improved by increasing the thickness of the ceramic substrate as a ferroelectric material, or decreasing the area of the electrode opposed thereto, this decreases the static capacity and, as a result, decreases the change of current flowing in the ballast and, accordingly, brings about a problem of lowering the starting pulse voltage.

SUMMARY OF THE INVENTION

In view of the above, the invention intends to retard the rate of deformation that is deformation velocity in the electrostrictive phenomenon caused by the discharge of a ferrodielectric ceramic capacitor when the dielectric breakdown is initiated between the electrodes of an arc tube without lowering the voltage of the starting pulse, thereby preventing the breakage accident of the capacitor as a technical subject.

For attaining the subject, the present invention intends to provide a metal halide lamp in which an arc tube that emits light by electric discharge between electrodes by an AC power supplied by way of a lamp power supply circuit, and a starting circuit that abruptly changes the current flowing in a ballast interposed in the lamp power supply circuit, thereby outputting a starting pulse at a high voltage from the ballast are housed being connected in parallel with each other in an outer tube, wherein the starting circuit has, in a serial connection, a ferroelectric ceramic capacitor that is charged and discharged when a voltage at a predetermined coercive voltage or higher is applied by way of the lamp power supply circuit and changes the current flowing in the ballast thereby outputting the starting pulse at the high voltage from the ballast, a semiconductor switch that turns to a conduction state when a voltage of a predetermined breakover voltage or higher is applied, and a time constant control resistor that retards the discharge time of electric charges discharged by way of a closed circuit extending from one electrode to the other electrode of the capacitor by way of the arc tube when the dielectric breakdown is initiated in the arc tube by the starting pulse.

According to the invention, an FEC (ferroelectric ceramic capacitor), a semiconductor switch, and a time constant control resistor are connected in series in the starting circuit.

Upon start-up of the arc tube, the semiconductor switch turns to the conduction state when the AC power source voltage applied by way of the lamp power supply circuit to the starting circuit exceeds a positive or negative breakover voltage on every one-half cycle, and electric charges at a high voltage are charged to the FEC which has been in a reverse saturation polarization state in the preceding AC cycle into the positive saturation polarization state to complete charging.

A current flows to the ballast during the discharging/charging operation from the reversed saturation polarization state to the normal saturation polarization state, and the current is decreased to 0 at the instance the FEC reaches the normal saturation polarization state.

In the ballast, since the flow of the current that has flown during the process in which the FEC is turned from the reverse saturation polarization state to the normal saturation polarization state stops suddenly, a starting pulse at a high voltage in accordance with the change with time of the current and the self inductance of the ballast is applied to the electrode of the arc tube and, as a result, the dielectric breakdown is initiated between the electrodes, and the operations described above are repeated till the arc tube transits to stable lighting.

On the other hand, when the electrodes of the arc tube are electrically conducted by the dielectric breakdown, a closed circuit is established by the starting circuit and the arc tube connected in parallel therewith and, at this instance, electric charges charged in the FEC are discharged abruptly from one of the electrodes of the FEC passing through the arc tube 33 to the other of the electrodes of the FEC.

Since the voltage of the starting pulse is applied and the electric charges are accumulated to the FEC till the generation of the dielectric breakdown, the electric charges are discharged at a discharge voltage equal with the maximum voltage value of the starting pulse (for example, 2.0 kV) depending on the timing of the dielectric breakdown. The time constant control resistor is interposed in the starting circuit to increase the time constant of the closed circuit.

Accordingly, when the resistance value of the time constant control resistor is selected so as to increase the time constant of the closed circuit, for example, to a twice value, since the discharge time of the FEC is also extended twice and the rate of deformation of the ferroelectric material that constitutes the FEC is lowered by so much, generation of cracking by the electrostrictive impact can be prevented reliably.

BRIEF DESCRIPTION OF THE DRAWINGS

FIG. 5 is a graph showing the effect of time constant control resistor in which

PREFERRED EMBODIMENT OF THE INVENTION

Figure 1:
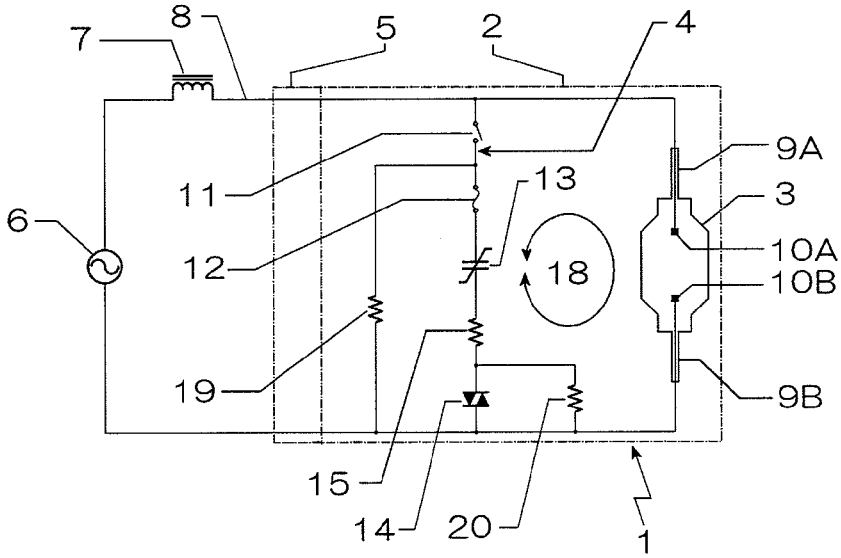
FIG. 1 is a circuit diagram showing an example of a metal halide lamp according to the invention.

For attaining the purpose of delaying the rate of deformation by the electrostrictive phenomenon caused by discharge of the ferroelectric ceramic capacitor when dielectric breakdown is initiated between the electrodes of the arc tube without lowering the voltage of the starting pulse, thereby preventing breakage accident of the FEC, this invention provides a metal halide lamp in which an arc tube that emits light by electric discharge between electrodes by an AC power supplied by way of a lamp power supply circuit and a starting circuit that abruptly changes the current flowing in a ballast interposed in the lamp power supply circuit thereby outputting a high voltage starting pulse from the ballast are housed being connected in parallel with each other in an outer tube, wherein the starting circuit has, connected in series therewith, a ferroelectric ceramic capacitor that is charged and discharged when a voltage at a predetermined coercive voltage or higher is applied by way of the lamp power supply circuit and outputs a starting pulse at a high voltage from a ballast, a semiconductor switch that is turned to a conduction state when a voltage of a predetermined breakover voltage or higher is applied, and a time constant control resistor that retards the discharge time of electric charges discharged from the capacitor when dielectric breakdown is initiated in the arc tube.

The present invention is to be described by way of a preferred embodiment shown in the drawings.

Figure 2:
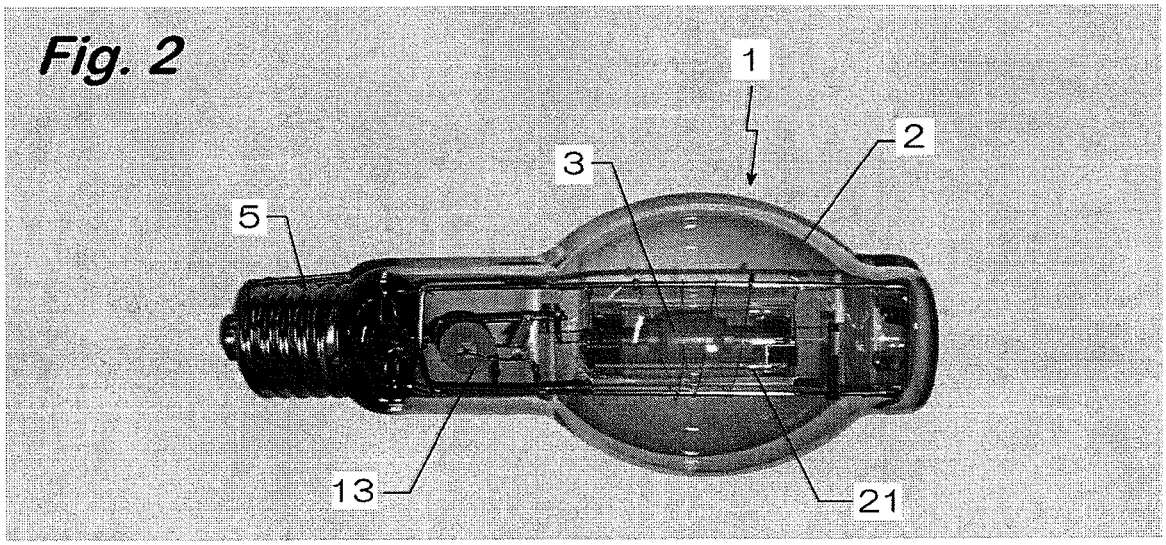
FIG. 2 is an outer view thereof.
Figure 3:
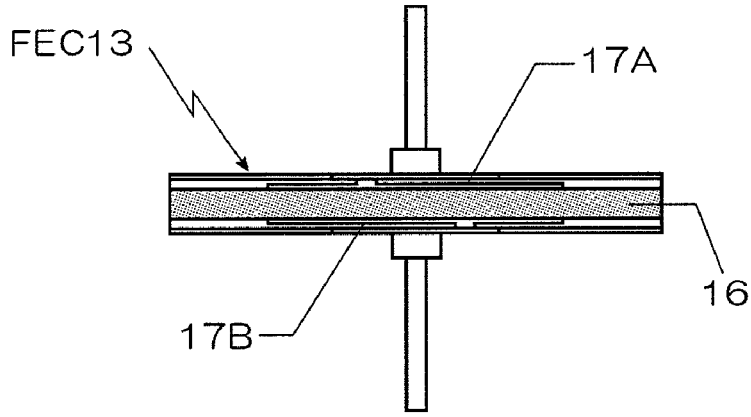
FIG. 3 is a cross sectional view of a ferroelectric ceramic capacitor.
Figure 4:
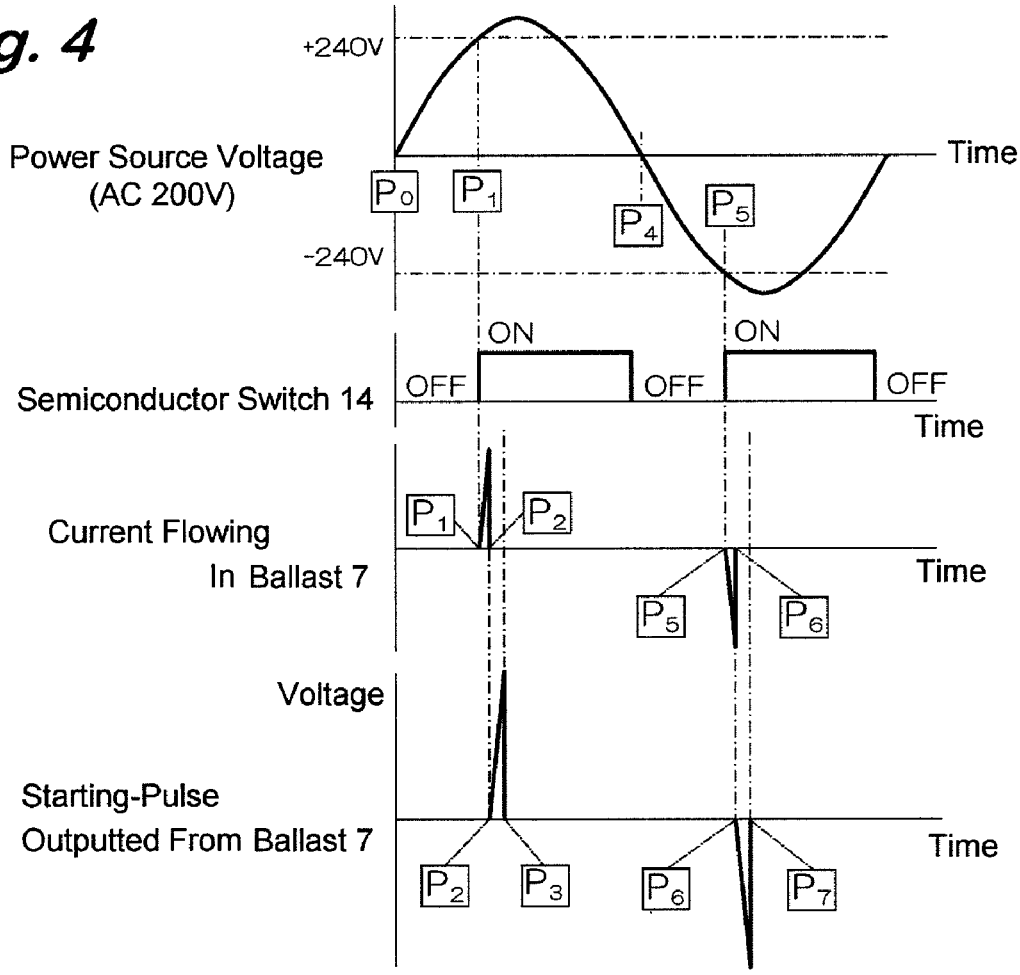
FIG. 4 is a graph showing voltage/current change upon start-up of the arc tube.
Figure 5A:
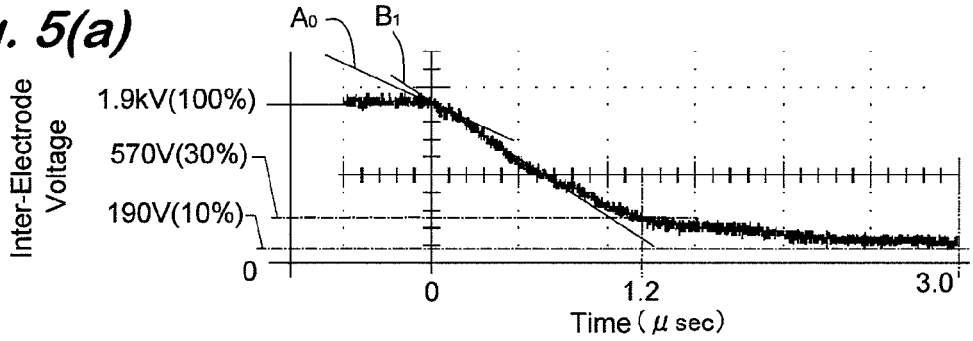
FIG. 5A is a graph where the time constant control register is interposed and FIG. 5B is a graph where the time constant control register is not interposed.
Figure 5B:
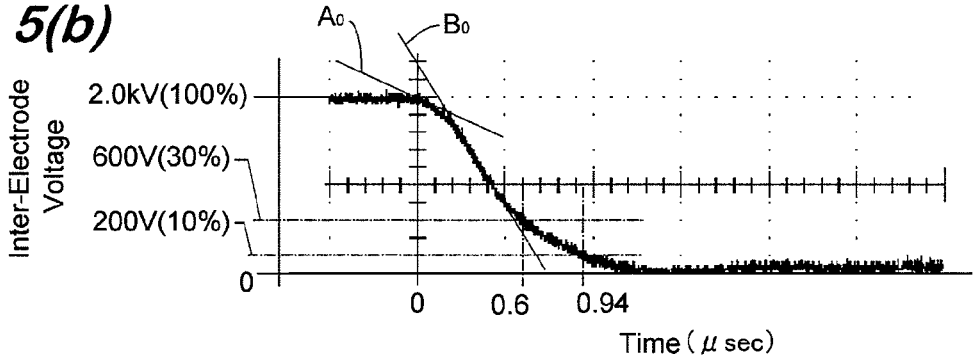
Figure 6:
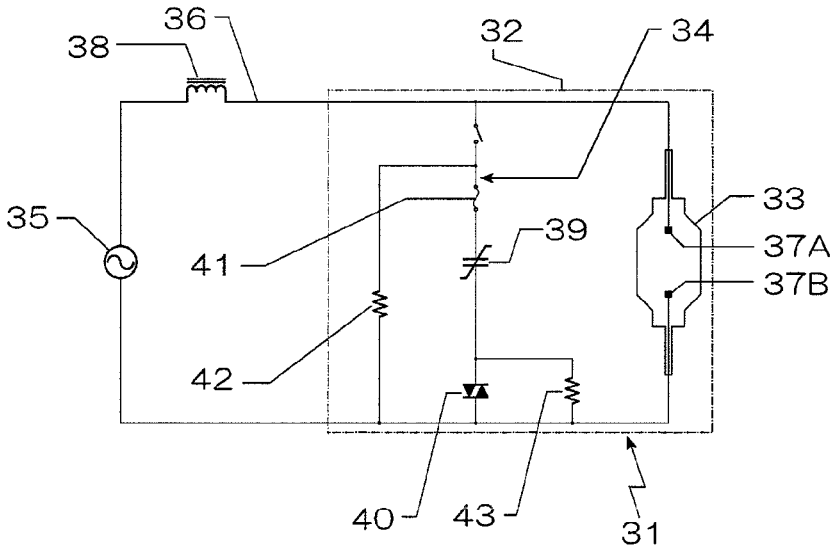
Fig. 6 (Prior Art)
FIG. 6 is a circuit diagram showing an existent apparatus.

FIG. 1 is a circuit diagram showing an example of a metal halide lamp according to the invention. FIG. 2 is an outer view thereof, FIG. 3 is a cross sectional view of a ferroelectric ceramic capacitor, FIG. 4 is a graph showing voltage/current change upon starting, and FIGS. 5A and 5B are graphs showing the effect of a time constant control resistance.

Embodiment 1

In a metal halide lamp 1 of this embodiment, an arc tube 3 and a starting circuit 4 are housed being connected in parallel with each other in an outer tube 2.

The outer tube 2 is made of transparent hard glass formed to a size capable of housing the arc tube 2 and the starting circuit 4. A base 5 is disposed on one end thereof such that they can be connected by way of the base 5 to a power supply circuit 8 having an AC power source 6 and a ballast 7 intervened therein. In this embodiment, an AC power source 6 at AC 200V (maximum value: ±282V) is used, and the ballast 7 conformed to a 400 W mercury lamp is used.

The arc tube 3 is formed of light transparent ceramics and housed while being contained in a protective tube 21 in the outer tube 2.

Then, electrodes 10A and 10B are inserted and sealed in both end seal portions 9A and 9B, metal halides such as of mercury, scandium, and sodium (metal vapors) are sealed together with an auxiliary starting gas in the inside of the tube and the arc tube emits light by electric discharge by an AC power supplied from the AC power source 6 by way of the lamp power supply circuit 8. In this embodiment, an arc tube having a rated power of 360 W is used.

In the starting circuit 4, a bimetal switch 11 of a type which is conducted at a normal temperature and shut off upon lighting of the lamp, a fusing resistor 12 at about 0.8 to 1.0Ω, a ferroelectric ceramic capacitor (FEC) 13, and a semiconductor switch 14 are connected in series, and a time constant control resistor 15 is interposed between an FEC 13 and a semiconductor switch 14.

When the metal vapors in the arc tube 3 leak into the outer tube 2 during lighting of the arc tube 3 thereby causing creeping discharge between the electrodes of the ferroelectric ceramic capacitor, the fusing resistor 12 is fused by an overcurrent flowing to the starting circuit 4 to prevent breakage of the FEC 13.

The FEC 13 is charged and discharged when a voltage higher than a predetermined coercive voltage is applied by way of the lamp power supply circuit 8 for changing a current that flows in the ballast 7 thereby outputting a starting pulse at a high voltage from the ballast 7.

In this embodiment, the FEC 13 is designed such that a ferroelectric material (bulk) 16 has a size of: thickness×diameter=1 mm×19 mm, the electrodes 17A, 17B have each a 16.8 mm diameter, and the coercive voltage is ±40 V, so that the capacitor is charged and discharged when the application voltage exceeds ±40 V.

The semiconductor switch 14 is, for example, a bilateral 2-terminal thyristor and functions as a switching device that turns to the conduction state when the application voltage increases to reach a predetermined breakover voltage so that a high voltage near the peak of the AC power source voltage can be applied to the FEC 13.

In this embodiment, the breakover voltage is set to ±200V when the power source voltage is, for example, 200 V (maximum value: ±282V).

Thus, when the AC power source voltage exceeds the total voltage (±240V) for the coersive voltage of the FEC 13 (±40V) and the breakover voltage of the semiconductor switch 14 (±200V), the semiconductor switch 14 turns to a conduction state to apply the power source voltage to the FEC 13, by which the FEC 13 that has been in the reverse saturation polarization state is discharged/charged and turns to the normal saturation polarization state, and a current flows to the ballast 7 during the charging/discharging operation.

Then, when the FEC 13 reaches the normal saturation polarization state, the current flowing in the ballast 7 is reduced to 0, and a starting pulse at a high voltage (about 1.6 to 2 kV) is outputted from the ballast 7 by the current change.

Further, the time constant control resistor 15 is used for delaying the discharge time of electric charges discharged from the FEC 13 when the dielectric breakdown is initiated between the electrodes 10A and 10B of the arc tube 3, and a resistor having a resistance value of 100Ω and a rated power of ¼ W is used in this embodiment.

It is considered that the phenomenon in which the dielectric breakdown is initiated between the electrodes 10A and 10B of the arc tube 3 and electric charges that are charged in the FEC 13 are discharged is that of electric discharge generated in the RC circuit 18 established by the starting circuit 4 and the arc tube 3, and it is considered that the discharge time from the starting of discharge to the completion of discharge depends on the impedance $R_0$ of the arc tube 3 and the resistance value $R_1$ of the time constant control resistor 15.

Then, the impedance $R_0$ of the arc tube 3 has a characteristic that it is high just after the dielectric breakdown (for example, after 0.05 μsec) and decreased abruptly after 0.2 to 0.3 μsec. On the other hand, since the time constant control resistor 15 is a fixed resistor having a constant resistance value $R_1$, a voltage drop curve by the time constant control resistor 15 can be represented by the basic formula for "RC discharge".

In this case, the time constant $T_1$ by the fixed resistance is represented as:

$$T_1=R_1C$$

where C represents the static capacitance of FEC 13, and it is considered that the discharge time of the RC circuit 18 suffers from the effect of the ingredient of the time constant $T_1$ and is retarded by so much.

However, when the resistance value $R_1$ of the time constant control resistor 15 is excessively high, since the current flowing in the ballast 7 is lowered and the voltage value for the starting pulse is lowered upon generation of the starting pulse by the ballast 7, the resistance value $R_1$ was determined to such a low level that the voltage value $V_0$ of the starting pulse can be maintained at 90% or higher of the voltage value of the starting pulse when the resistance value of the time constant control resistor 15 is 0.

In this embodiment, a carbon film resistor having a value $R_1$=100Ω was used as the time constant control resistor 15, and the voltage value $V_1$ for the starting pulse was 92% of the voltage value $V_0$.

Then, a pyroelectric current bypass resistor 10 is connected in parallel with the FEC 13 for bypassing a pyroelectric current that is generated when the temperature of the FEC 13 exceeds a curie temperature of about 90° C. thereby preventing the degradation of characteristics thereof, and a bypass phase stabilizing resistor 20 is connected in parallel with the semiconductor switch 14.

A constitutional example of the invention is as has been described above, and the operation thereof is to be described for the operation of each of the devices along with the voltage change of the AC waveform with reference to FIG. 4 and FIG. 5.

When a switch (not illustrated) is turned on and a power source voltage at AC 200V is supplied from the AC power source 6 by way of the power supply circuit 8, the AC voltage is outputted as a sinusoidal waveform having a peak at ±282V.

[FIG. 4: Between $P_0$ to $P_1$, Between $P_4$ to $P_5$]

At first, since each of the electrodes 10A and 10B of the arc tube 3 is in a state insulated from each other and the semiconductor switch 14 of the starting circuit 4 is also in a non-conduction state till the power source voltage reaches from 0 to ±240V, no current flows at all to the starting circuit 4 and the lamp power supply circuit 8.

[FIG. 4: Between $P_1$ to $P_2$, Between $P_5$ to $P_6$]

Then, when the power source voltage exceeds the total voltage (±240) for the coersive voltage (±40V) of the FEC 13 and the breakover voltage (±200V) of the semiconductor switch 14, the semiconductor switch 14 turns to a conduction state, the power source voltage is applied to the FEC 13, the FEC 13 which has been in the reverse saturation polarization state in the preceding AC cycle is discharged/charged and inverted into the normal saturation polarization state, and a current flows to the ballast 7 in a moment where the charging/discharging operations are being conducted.

[FIG. 4: Between $P_2$ to $P_3$, Between $P_6$ to $P_7$]

Since the current flowing in the ballast 7 is reduced to 0 when the FEC 13 reaches the normal saturation polarization state, a starting pulse at a high voltage (for example, 2 kV) is outputted by the change of current from the ballast 7.

Then, a starting pulse at a high voltage is outputted on every one-half cycle of the AC cycle during a period of from several deciseconds to ten and several seconds from the beginning of start-up, and the dielectric breakdown is initiated intermittently between the electrodes 10A and 10B of the arc tube 3 and, thereafter, the lamp transits to stable lighting.

That is, the electrodes of the arc tube 3 repeat dielectric breakdown/lighting failure and starting pulses are outputted by several times to several hundreds times till the lighting emitting tube reaches stable lighting.

On the other hand, once the dielectric breakdown is initiated, electric charges accumulated in the FEC 13 are discharged from one electrode 17A (17B) to the other electrode 17B (17A) of the FEC 13 by way of the arc tube 3, and the potential between the electrodes of the FEC 13 is reduced to 0.

In this case, since the voltage of the starting pulse is applied to the FEC 13 till the instance just before the generation of the dielectric breakdown, the discharge voltage is equal with the voltage of the starting pulse when the dielectric breakdown is initiated.

Since the power source voltage when the starting pulse is outputted is about 240 V and the starting pulse changes momentarily from 240V to 2 kV, the discharge voltage of the FEC 13 reaches 2 kV at the maximum.

Then, the FEC 13 is discharged by the dielectric breakdown and the inter-electrode voltage thereof changes from 2 kV to 0 V. Since the time constant control resistor 15 is interposed in the starting circuit 4 that shorts-circuit the electrodes of the FEC 13 at this instance, the time constant is increased and the discharge time is retarded.

Accordingly, even when the inter-electrode voltage changes from 2 kV to 0V by the discharge of the FEC 13, since the rate of change is slow, the deformation of the ferroelectric material of the FEC 13 occurs at a moderate rate, if it is deformed by electrostriction.

Accordingly, the amount of deformation of the ferroelectric material per unit time is decreased and this exert no impact, thereby capable of decreasing damages given to the FEC 13.

FIG. 5 is a graph showing the result of an experiment of constructing an equivalent circuit for the RC circuit 18 formed by the starting circuit 4 and the arc tube 3 which is put to the dielectric breakdown, discharging the FEC 13 charged at an application voltage of about 2 kV, and measuring the change of voltage across both ends of the FEC 13.

FIG. 5A shows the result of an experiment on an equivalent circuit in which the time constant control resistor 15 is interposed and FIG. 5B shows the result, for comparison, of an experiment on a circuit in which the time constant control resistor 15 is not interposed.

In a case where the time constant control resistor 15 is not interposed, impedance values for those other than the arc tube 3 are nearly equal to 0, and the impedance $R_0$ for the arc tube 3 is high just after the dielectric breakdown (for example, after 0.05 μsec) and decreased abruptly after 0.2 to 0.3 μsec.

As a result, the voltage drops in the arc tube 3 (corresponding to the inter-electrode voltage of the FEC 13) as shown in FIG. 5B, in which the voltage drops along a moderate slope $A_0$ till 0.2 μsec from the dielectric breakdown and then drops along an abrupt slope $B_0$ after lapse of 0.3 μsec.

Accordingly, the inter-electrode voltage of the FEC 13 charged to about 2 kV drops to 30% thereof (600 V) in a discharge time only of about 0.6 μsec.

On the other hand, in a case of interposing the time constant control resistor 15, the voltage drop curve due to the fixed resistance is identical with that of the basic formula for "RC discharge", in which the impedance for the RC circuit 18 (circuit resistance) is maintained at a synthesis impedance obtained by synthesizing the impedance ($R_0$) for the arc tube 3 and the resistance value ($R_1$) for the time constant control resistor 15 as: $(R_0+R_1) \geqq R_1$.

Accordingly, the voltage drops along a moderate slope $A_0$ till 0.2 μsec after the dielectric breakdown and then drops along a relatively moderate slope $B_1$ also after lapse of 0.3 μsec as shown in FIG. 5A.

Accordingly, the discharge time in which the inter-electrode voltage of the FEC 13 charged to about 1.9 kV drops to 30% thereof (570 V) is about 1.2 μsec.

Further, when comparing the time till the inter-electrode voltage drops from 100% to 10% thereof, the discharge time in which the inter-electrode voltage drops to 10% (200V) thereof is 1 μsec or less in a case of not interposing the time constant control resistor 15 as shown in FIG. 5B, whereas the inter-electrode voltage does not drop to 10% (190V) thereof even after lapse of 3.0 μsec in a case of interposing the time constant control resistor 15 as shown in FIG. 5A.

As described above, in this embodiment, since the discharge time is extended by interposing the time constant control resistor 15, the rate of deformation in the electrostriction of the FEC 13 generated by the starting pulse on every dielectric breakdown can be lowered during the process from the start of lighting till stable lighting and the impact shock caused by the discharge of the FEC 13 can be moderated to prevent generation of cracking or breakage, thereby capable of extending the life time of the lamp.

As has been described above, the present invention is applicable to the use of a metal halide lamp incorporating a starting circuit having a ferroelectric ceramic capacitor.

DESCRIPTION FOR REFERENCES

1 metal halide lamp
2 outer tube
3 arc tube
4 starting circuit
6 AC power source
7 ballast
8 power supply circuit
12 fusing resistor
13 FEC (ferroelectric ceramic capacitor)
14 semiconductor switch
15 time constant control resistor

What is claimed is:

1. A metal halide lamp in which an arc tube and a starting circuit are housed, the arc tube emitting light by electric discharge between electrodes by an AC power supplied by way of a lamp power supply circuit, the starting circuit abruptly changing current flowing in a ballast interposed in the lamp power supply circuit to output a starting pulse at a high voltage from the ballast, the arc tube and the starting circuit being connected in parallel with each other in an outer tube, wherein the starting circuit includes:

a ferroelectric ceramic capacitor that is charged and discharged when a voltage at a predetermined coersive voltage or higher is applied by way of the lamp power supply circuit and changes the current flowing in the ballast thereby outputting the starting pulse at the high voltage from the ballast, a semiconductor switch that turns to a conduction state when a voltage of a predetermined breakover voltage or higher is applied, and a time constant control resistor that retards the discharge time of electric charges discharged by way of a closed circuit extending from one electrode to the other electrode of the capacitor by way of the arc tube when dielectric breakdown is initiated in the arc tube by the starting pulse, wherein a substantially common current flows through the ferroelectric ceramic capacitor, the semiconductor switch and the time constant control resistor, when the dielectric breakdown is initiated in the arc tube by the starting pulse.

2. The metal halide lamp according to claim 1, wherein a fusing resistor that is fused by an overcurrent flowing in the starting circuit when metal vapors in the arc tube are leaked to the inside of the outer tube thereby causing creeping discharge between the electrodes of the ferroelectric ceramic capacitor is interposed in the starting circuit.

3. The metal halide lamp according to claim 1, wherein the resistance value of the time constant control resistor is selected such that the voltage value of the starting pulse is 90% or higher of the voltage value of the starting pulse when the resistance value of the time constant control resistor is 0.

4. The metal halide lamp according to claim 2, wherein the resistance value of the time constant control resistor is selected such that the voltage value of the starting pulse is 90% or higher of the voltage value of the starting pulse when the resistance value of the time constant control resistor is 0.

5. The metal halide lamp according to claim 1, wherein, the ferroelectric ceramic capacitor, the semiconductor switch and the time constant control resistor are connected in series without a switch that is connected in parallel to the time constant control resistor.

6. The metal halide lamp according to claim 1, wherein the time constant control resistor is provided between the ferroelectric ceramic capacitor and the semiconductor switch.

* * * * *